United States Patent [19]

Garcia

[11] 4,040,136

[45] Aug. 9, 1977

[54] WING TO SWIM

[76] Inventor: Onofre S. Garcia, 77 Prospect St., Newark, N.J. 07105

[21] Appl. No.: 576,046

[22] Filed: May 9, 1975

Related U.S. Application Data

[60] Division of Ser. No. 500,921, Aug. 27, 1974, Pat. No. 3,913,516, which is a continuation-in-part of Ser. No. 409,277, Oct. 24, 1973, abandoned.

[51] Int. Cl.[2] ..... A63B 31/00

[52] U.S. Cl. ..... 9/302; 9/308

[58] Field of Search ..... 9/301-308

[56] References Cited

U.S. PATENT DOCUMENTS

| | | | |
|---|---|---|---|
| 1,318,451 | 10/1919 | Katzmarek | 9/302 |
| 1,522,526 | 1/1925 | Kuhn | 9/302 |
| 1,695,125 | 12/1928 | Rensing | 9/302 |
| 1,779,590 | 10/1930 | Eilers | 9/302 |
| 3,286,287 | 11/1966 | Martin | 9/308 |

*Primary Examiner*—Trygve M. Blix
*Assistant Examiner*—Sherman D. Basinger

[57] ABSTRACT

A wing to swim which includes a sleeve to attach to a member to be manipulated under water in generally fore to aft cycles of movement and an umbrella type collapsible canopy carried by the sleeve and moveable in response to water forces caused by the manipulation between canopy open position and a canopy collapsed position to propel an object through water.

1 Claim, 4 Drawing Figures

WING TO SWIM

This application is a division of Ser. No. 500,921 filed Aug. 27, 1974 and now U.S. Pat. No. 3,913,516, which is a continuation-in-part of Ser. No. 409,277 filed Oct. 24, 1973, and now abandoned.

FIELD OF THE INVENTION

This invention relates to a device for use by a swimmer or for propulsion through water.

BACKGROUND OF THE INVENTION

In the past it has been known to attach various type of devices to a body to be propelled through water in response to manipulation of the devices below the water surface. For example, U.S. Pat. No. 1,522,526 is of such a device. This invention is an improved device of the general class of attachments of which the above mentioned patent is typical.

OBJECTS OF THIS INVENTION

This invention has as a general object the provision of a wing or umbrella canopy which is simple and inexpensive to manufacture and is well adapted for use as an attachment to the legs or arms of a swimmer; and the invention provides a sleeve to receive the member to which it is secured and an attachment means to maintain the sleeve in a predetermined position on the member; and on the sleeve a collapsible umbrella type canopy or wing is secured and supported by pivotal struts and constrained upon movement of the device to movement between an open and a closed position in response to forces exerted upon it by manipulation of the device in water to create propulsion forces through water.

It is also an object of this invention to provide a device of the type described which is adapted by reason of its structure and configuration to be used as an attachment for the leg or arm of a swimmer and which includes a glove portion or sock portion to accommodate the hand or foot of the wearer and includes a sleeve of sufficient length to transmit substantial forces of propulsion to the arm or leg in use and which is configured so as not to scrape against the body of a swimmer.

In accordance with these general objects and other objects which will be apparent from the following description, the invention in three preferred embodiments will now be described with reference to the accompanying drawings.

DESCRIPTION OF PREFERRED EMBODIMENTS

First Preferred Embodiment

Figure 1:
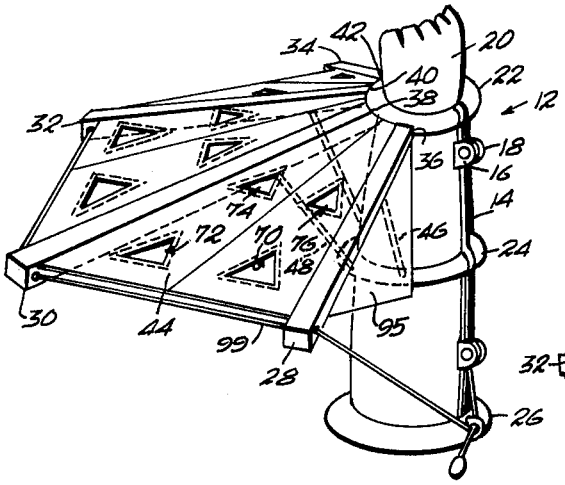
FIG. 1 is a perspective view of a first preferred embodiment of the device adapted for attachment to the arm of a wearer.
Figure 2:
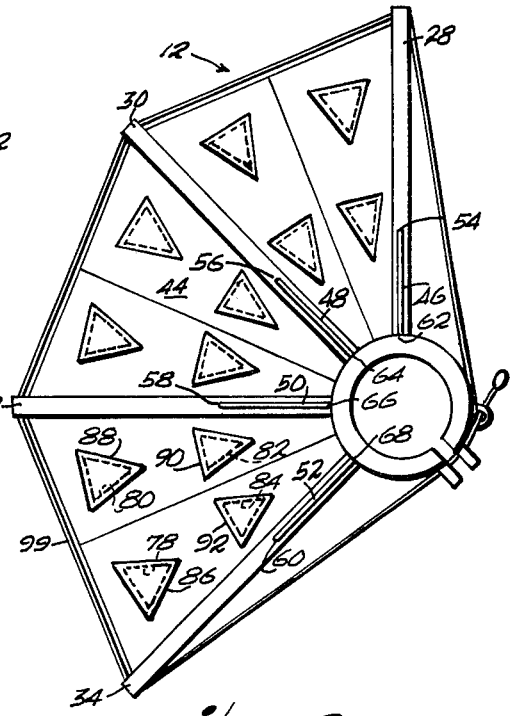
FIG. 2 is a bottom view of the device shown in FIG. 1.

The first preferred embodiment of FIGS. 1 and 2 is adapted to be used on a swimmer's left arm. A mirror image of the device may be worn on a swimmer's right arm and will not be described further. The device generally designated by the numeral 12 includes a sleeve 14 which is preferably of flexible plastic material or sturdy cloth, such as canvas. It includes means to secure it to the distal end of the arm of a swimmer, such as belts not showns or mating locks 16 and 18 which are adapted to be tied together. A glove segment 20 may be provided at the very end for passage of a hand. Reinforcing rings 22, 24 and 26 may be provided. To the end of the sleeve a plurality of equispaced struts 28, 30, 32 and 34 are pivotally connected as at 36, 38, 40 and 42; and the struts extend a common distance. The struts are spanned by a canopy 44 of water impervious plyable material, such as plastic, which is in the shape of a segment of a circle as seen from an end view and is suitably secured to form what may be described as a collapsible wing extending outwardly from the sleeve. The canopy may be composed of a plurality of generally triangularly shaped circle segments, as shown, each secured in spanning relation between adjacent struts. Flexible string means of a common length 46, 48, 50 and 52 connect the struts to the sleeve by suitable means, such as staples as at 54, 56, 58 and 60 and 62, 64, 66 and 68 on the sleeve preferably at the reinforced zone 24. In the preferred embodiment one way check valve means such as 70, 72, 74 and 76 may be provided and comprise openings 78, 80, 82 and 84 at predetermined spaced locations of the wing canopy which on the inside surface are covered by patches 86, 88, 90 and 92 which have margins that overlay the margins of the canopy about their respective associated openings. The margins are secured to the canopy at spaced point so that when the wing is pulled toward the elbow through water, the margins will closely overlay one another and not permit water to flow through the openings, but will open when the wing is pushed forwardly through water. Also, when the wing is pushed forwardly the wing will collapse as the struts pivotally approach allignment with the sleeve centerline; and when the wing has completed a forward stroke of a swimming cycle and pulled rearwardly, the canopy by pivotal action of the struts will open in response to the forces exerted by the water to a fully opened position shown in FIG. 1 with the string means being taut and restraining further movement until rearward movement has been completed. A flexible end flap 95 to trap water may be included on the wing.

Second Preferred Embodiment

Figure 3:
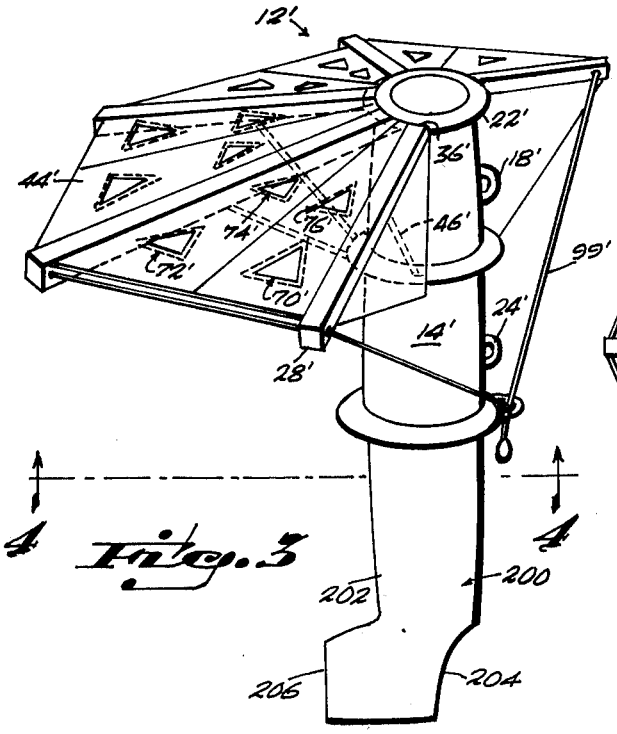
FIG. 3 is a perspective view of a second preferred embodiment adapted for attachment to the leg and foot of a wearer.
Figure 4:
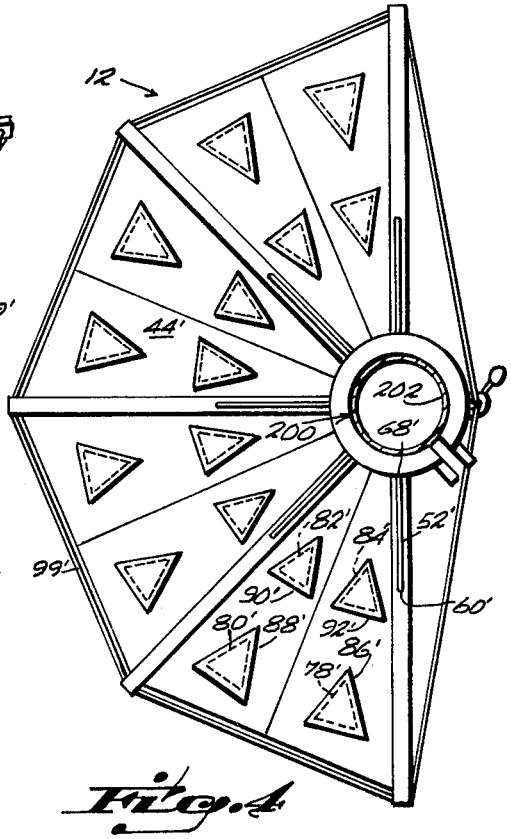
FIG. 4 is a bottom view of the device of FIG. 3.

The second preferred embodiment of FIGS. 2 and 3 is adapted to be used on a swimmer's foot. It differs from the previously described embodiment in that a partial flexible sock 200 is suitably secured at the distal end 202, which preferably is cut away at the heel zone 204 and tow zone 206. In operation this embodiment is secured to the foot and used similarly to the description aforesaid. Rather than repeat the numbers and description in all detail with respect to this embodiment, similar parts of the wing corresponding to the embodiment of FIGS. 1 and 2 are designated by a series of corresponding numbers with a prime designation.

In each of the embodiments the canopy when collapsed may be secured in close collapsed relation about the shaft arm or leg, for example, as shown in FIGS. 1 and 2 by use of the drawn string 99.

What is claimed is:

1. A device for attachment to a member to be manipulated in water to cause forces of propulsion, said device comprising:

a sleeve having a first end zone and a second end zone and being characterized by a longitudinal centerline, a plurality of equi-spaced struts each of a common length and each having a first end and a second end, pivot means connecting the first end of each strut to the first end zone, said struts being swingable from a first position of general alignment of said struts with said sleeve and a second position of said struts extending radially outwardly and rearwardly toward said second end zone;

stop means to limit swinging movement of the second end of each of said struts toward said first end zone, said stop means defining said second position, said second position being such that each of said struts is oriented at a substantially common angle of divergence with respect to the centerline of said sleeve and with the second ends being in a substantially common transverse plane with respect to the sleeve centerline and said second ends defining a curved line in said plane of a substantially common radius from said centerline;

a flexible canopy connected to each of said struts and spanning the space between said struts and said sleeve; and said sleeve being of an axial length greater than the distance between the first end zone and said transverse plane;

means to connect said sleeve to a member;

said curved line defines a sector of a circle;

said sleeve is of flexible material; and the device includes tie means to hold the struts in said first position when not in use, said tie means including a draw string connected to said second end zone and to said second end of each strut whereby the second end of each strut may be pulled toward and secured to the second end zone by said drawn string;

a glove portion on said first end zone and opening into said sleeve; and said sleeve including circumferential reinforcing zones at spaced locations along the length of said sleeve.

* * * * *